US008781342B2

(12) United States Patent
Endo

(10) Patent No.: US 8,781,342 B2
(45) Date of Patent: Jul. 15, 2014

(54) IMAGE FORMING APPARATUS WITH A FUNCTION OF DETECTING AN AMOUNT OF REMAINING DEVELOPING AGENT

(75) Inventor: Yoshinori Endo, Toyota (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 319 days.

(21) Appl. No.: 13/234,941

(22) Filed: Sep. 16, 2011

(65) Prior Publication Data

US 2012/0070166 A1 Mar. 22, 2012

(30) Foreign Application Priority Data

Sep. 17, 2010 (JP) ..... 2010-209406

(51) Int. Cl.
*G03G 15/08* (2006.01)
*G03G 15/10* (2006.01)

(52) U.S. Cl.
USPC ..... 399/27; 399/64

(58) Field of Classification Search
USPC ..... 399/61, 64, 27
See application file for complete search history.

(56) References Cited

U.S. PATENT DOCUMENTS

| | | | | |
|---|---|---|---|---|
| 6,501,933 | B2 * | 12/2002 | Ishii | 399/27 X |
| 6,661,980 | B2 | 12/2003 | Matsumoto et al. | |
| 6,912,366 | B1 | 6/2005 | Yamamoto et al. | |
| 7,263,300 | B2 | 8/2007 | Ishii et al. | |
| 2002/0127024 | A1 | 9/2002 | Matsumoto et al. | |
| 2003/0175039 | A1 * | 9/2003 | Yamamoto et al. | 399/27 |
| 2004/0086286 | A1 | 5/2004 | Ishii et al. | |

FOREIGN PATENT DOCUMENTS

| | | | |
|---|---|---|---|
| JP | 4-136964 | A | 5/1992 |
| JP | 04-338780 | A | 11/1992 |
| JP | 07-234582 | A | 9/1995 |
| JP | 9-034238 | A | 2/1997 |
| JP | 9-325594 | A | 12/1997 |
| JP | 11-102111 | A | 4/1999 |
| JP | 2001-100508 | A | 4/2001 |
| JP | 2001-201988 | A | 7/2001 |
| JP | 2002-268361 | A | 9/2002 |
| JP | 2004-029396 | A | 1/2004 |
| JP | 2006-184734 | A | 7/2006 |
| JP | 2006-243259 | A | 9/2006 |

OTHER PUBLICATIONS

JP Office Action dtd Jan. 24, 2013, JP Appln. 2010-209406, English translation.

* cited by examiner

*Primary Examiner* — Sandra Brase
(74) *Attorney, Agent, or Firm* — Banner & Witcoff, Ltd.

(57) ABSTRACT

An image forming apparatus is provided that includes an image forming unit including an agitation unit for agitating developing agent contained in a container unit, and a sensor which includes a light emitting unit configured to emit light and a light receiving unit configured to receive the light emitted from the light emitting unit and passing through the container unit. The sensor generates an output in accordance with an amount of light received by the light receiving unit while the agitation unit agitates the developing agent. The image forming apparatus also includes has a medium with instructions stored therein that when executed perform steps including calculating a measurement result based on the output generated by the sensor, and determining, after the agitation is started, whether a current period is an unstable period in which the measurement result is unstable or a stable period in which the measurement result is stable.

10 Claims, 10 Drawing Sheets

IMAGE FORMING APPARATUS WITH A FUNCTION OF DETECTING AN AMOUNT OF REMAINING DEVELOPING AGENT

CROSS REFERENCE TO RELATED APPLICATION

This application claims priority from Japanese Patent Applications No. 2010-209406 filed on Sep. 17, 2010. The entire content of each of these priority applications is incorporated herein by reference.

BACKGROUND

1. Field

Aspects of the disclosure relate to an image forming apparatus and, more particularly, to an image forming apparatus with a function of detecting an amount of remaining developing agent.

2. Description of the Related Art

A technique regarding a toner sensor which optically detects an amount of remaining toner (i.e., a developing agent) in electrophotographic image forming apparatuses has been known. In such a toner sensor, a light emitting unit and a light receiving unit of the toner sensor are disposed opposite to each other across a toner container unit provided in a development cartridge and the light emitting unit emits light toward the light receiving unit. The light emitted from the light emitting unit and passed through the toner container unit is received by the light receiving unit. A change in an amount of light received in the light receiving unit caused by the flow of the toner between the light emitting unit and the light receiving unit of the sensor while the agitator which agitates the toner in the toner container unit is rotated is measured, and an amount of remaining toner is detected in accordance with the measurement result.

SUMMARY

Usually, if the toner in the container unit is left unagitated for long periods of time, particle density of the toner increases and toner volume decreases. As a result, flowability of toner is lowered. The lowered flowability of toner is improved when the toner is fully agitated with an agitator.

When the toner has sufficient flowability, the toner flows smoothly between the light emitting unit and the light receiving unit of the toner sensor; thus an amount of remaining toner can be detected with high precision.

In contrast, when the toner has lowered flowability, the toner does not flow smoothly between the light emitting unit and the light receiving unit of the toner sensor; thus detection precision of the amount of remaining toner may be lowered.

SUMMARY

Aspects of the disclosure relate to a technique for accurately detecting an amount of remaining developing agent.

DETAILED DESCRIPTION

First Illustrative Embodiment

A first illustrative embodiment will be described with reference to FIGS. 1 to 8.

Configuration of Printer

Here, a configuration of a printer 10 will be described.

Figure 1:
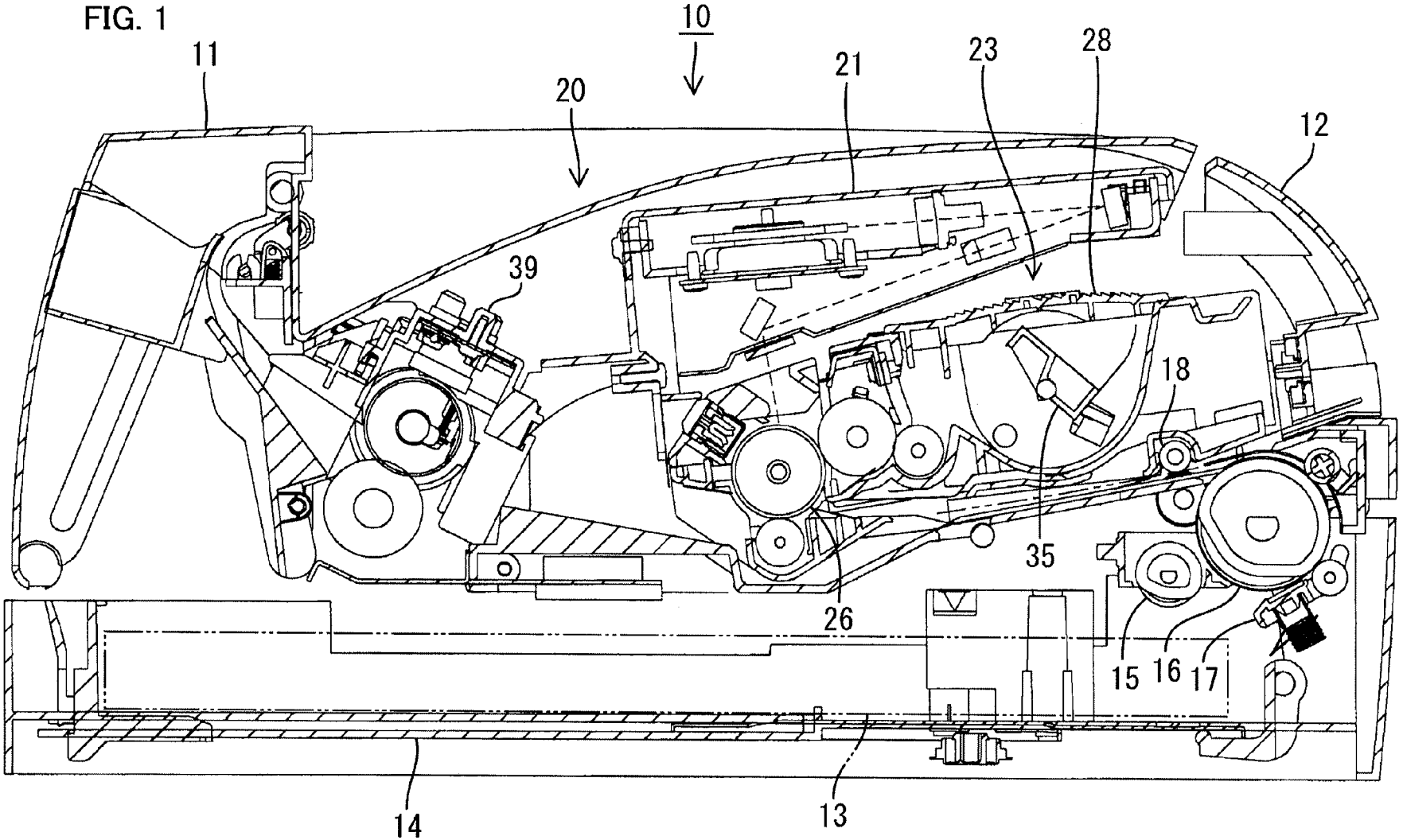
FIG. 1 is a side sectional view of a configuration of a printer according to a first illustrative embodiment.

FIG. 1 is a side sectional view of the configuration of the printer 10. The printer 10 (which is an example of the image forming apparatus) is an electrophotographic laser printer. In the following description, the right side of FIG. 1 is defined as the front side.

The printer 10 is provided with an apparatus main body 11 and an openable/closable front cover 12 is provided at the front of the apparatus main body 11. At the bottom of the apparatus main body 11, a supply tray 14 is provided on which a plurality of sheets (e.g., paper sheets and OHP sheets) 13 can be stacked. The sheets 13 stacked on the supply tray 14 are fed forward by a pickup roller 15 from a top sheet, separated into individual sheets when nipped by a feed roller 16 and a separating pad 17, and conveyed to a resist roller 18 by the feed roller 16. The resist roller 18 conveys the sheet 13 to the image forming unit 20.

The image forming unit 20 is provided with a scanner unit 21, a process cartridge 23 and a fixing unit 39.

The scanner unit 21 irradiates a later-described photoconductor drum 26 with laser light. Irradiation of the laser light is controlled in accordance with print data.

Figure 2:
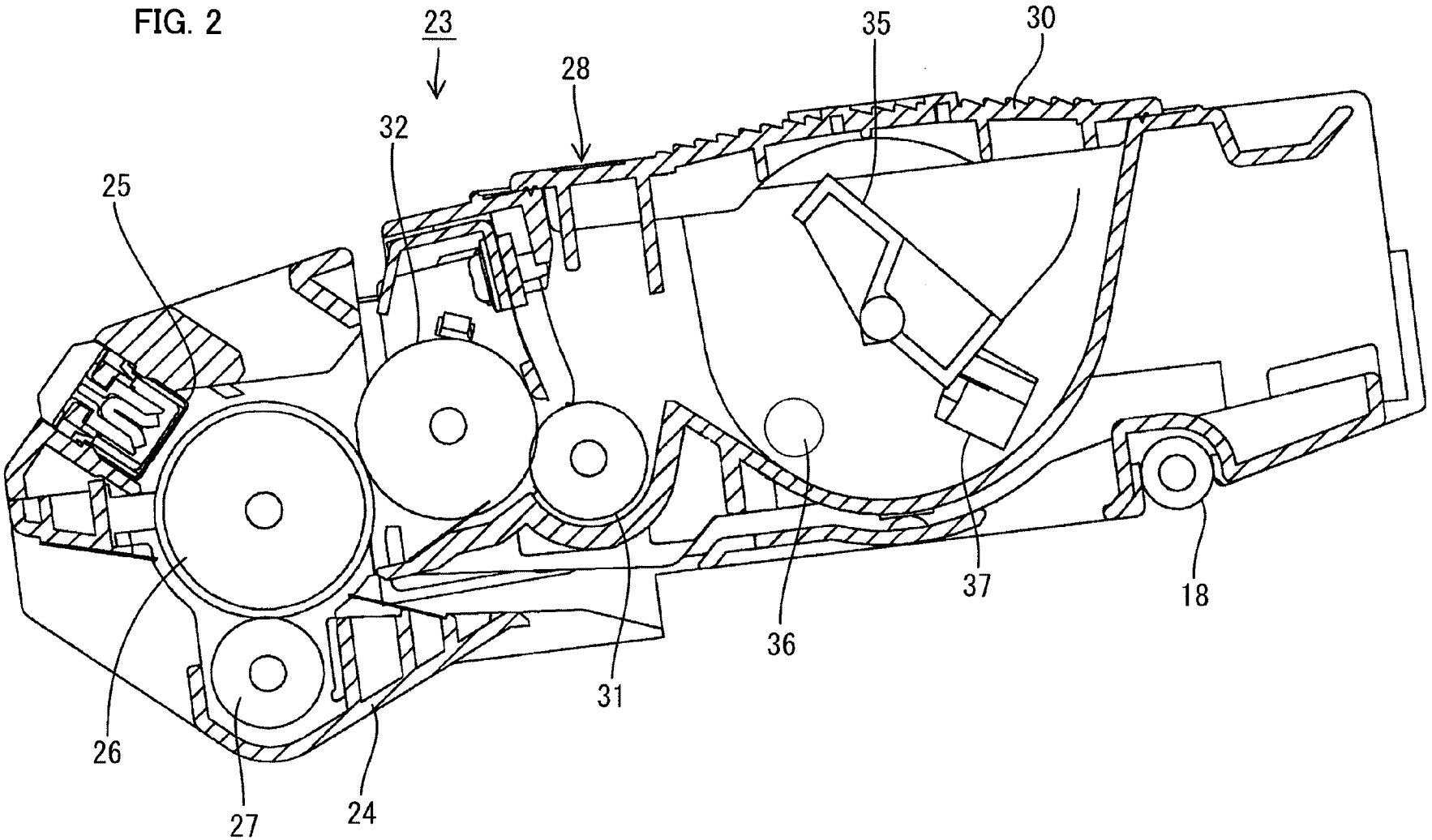
FIG. 2 is a side sectional view of a process cartridge according to an illustrative embodiment.
Figure 3:
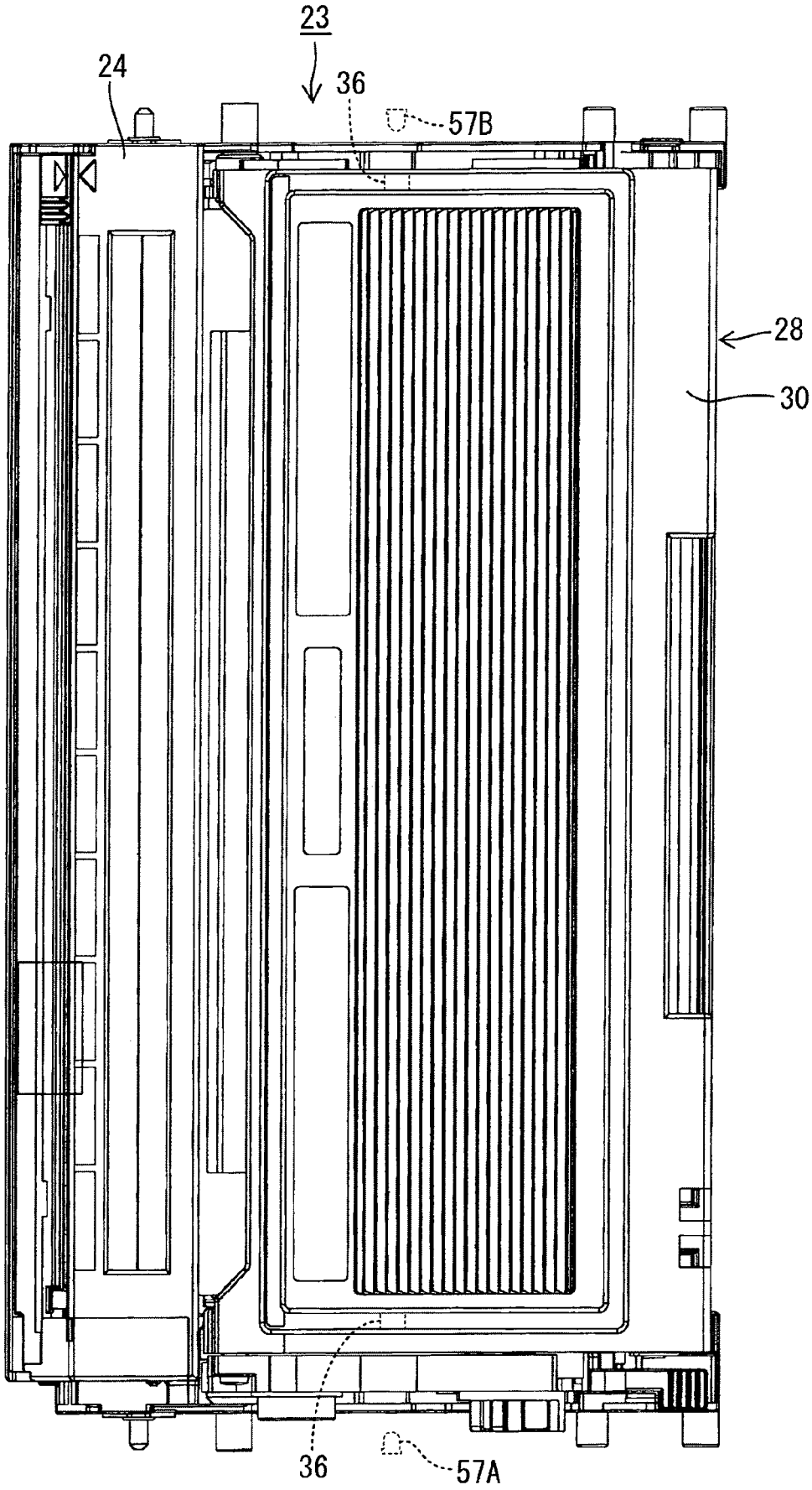
FIG. 3 is a plan view of the process cartridge.
Figure 4:
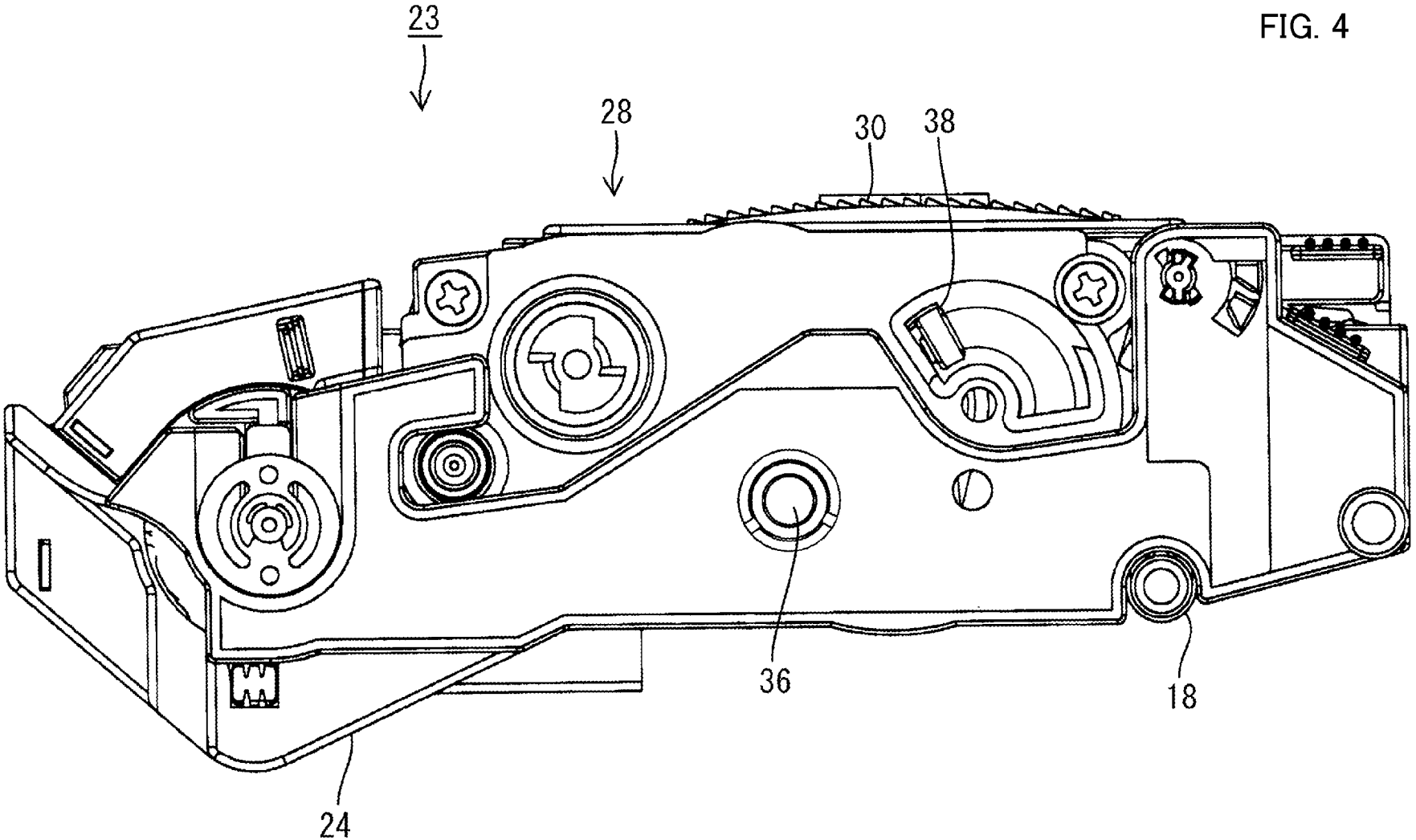
FIG. 4 is a side view of the process cartridge.

FIG. 2 is a side sectional view of the process cartridge 23, FIG. 3 is a plan view of the process cartridge 23 and FIG. 4 is a side view of the process cartridge 23.

When the front cover 12 is opened, the process cartridge 23 can be removably attached to the apparatus main body 11. As illustrated in FIG. 2, the process cartridge 23 is provided with a charging unit 25 supported by a frame 24, a photoconductor drum 26, a transfer roller 27 and a development cartridge 28 which is removably attached to the frame 24.

The development cartridge 28 is provided with a container unit 30 which contains a developing agent such as toner in this example, and a feed roller 31 and a developing roller 32 which are disposed behind the container unit 30.

An agitator 35 (which is an example of the agitation unit) is provided in the container unit 30. The agitator 35 is driven by a later-described main motor 56 to rotate clockwise in the drawing. The agitator 35 is rotated to agitate the toner in the container unit 30 and scrapes the toner out on the feed roller 31 side.

Each of the side walls of the container unit 30 is provided with a window unit 36 for the later-described detection of an amount of remaining toner. Wipers 37 are provided at both ends of the agitator 35. As the agitator 35 rotates, the wipers 37 wipe the window units 36 to clean the same.

As illustrated in FIG. 4, a detector member 38 used for detecting whether or not the development cartridge 28 is unused is provided on an outer surface of one of the side walls of the container unit 30. The detector member 38 can be displaced irreversibly from an unused cartridge position representing that the development cartridge 28 is unused to a used cartridge position representing that the development cartridge 28 is not an unused cartridge. The detector member 38 is moved to the used cartridge position from the unused cartridge position by a mechanism (not shown) provided inside the apparatus main body 11 when the development cartridge 28 is used the first time.

Image Formation Process

Here, an image formation process in which the printer 10 forms an image on a sheet will be described.

First, the printer 10 causes the agitator 35 to rotate so that the toner is fed from the container unit 30 to the feed roller 31.

The printer 10 then causes the feed roller 31 to rotate so that the toner fed from the container unit 30 is supplied to the developing roller 32.

Next, the printer 10 causes the toner to be rubbed and electrically charged between the feed roller 31 and the developing roller 32.

The printer 10 causes the charging unit 25 to charge a surface of the photoconductor drum 26.

Next, the printer 10 causes the scanner unit 21 to irradiate the surface of the photoconductor drum 26 with laser light so as to expose the surface of the photoconductor drum 26. With this exposure to light, an electrostatic latent image is formed on the surface of the photoconductor drum 26.

Next, the printer 10 causes the toner to be supplied from the developing roller 32 to the electrostatic latent image for developing the same. Thus a toner image is formed on the surface of the photoconductor drum 26.

Next, the printer 10 causes the sheet 13 to be conveyed between the photoconductor drum 26 and the transfer roller 27.

The printer 10 then applies transfer bias between the photoconductor drum 26 and the transfer roller 27 so that the toner image on the surface of the photoconductor drum is transferred to the sheet 13 conveyed therebetween.

Next, the printer 10 causes the sheet 13 having the toner image transferred thereto to be conveyed to the fixing unit 39 illustrated in FIG. 1 where the toner image is fixed to the sheet 13.

Finally, the printer 10 causes the sheet 13 having the toner image fixed thereto to be discharged to an upper surface of the apparatus main body 11.

Electrical Configuration of Printer

Here, an electrical configuration of the printer 10 will be described.

Figure 5:
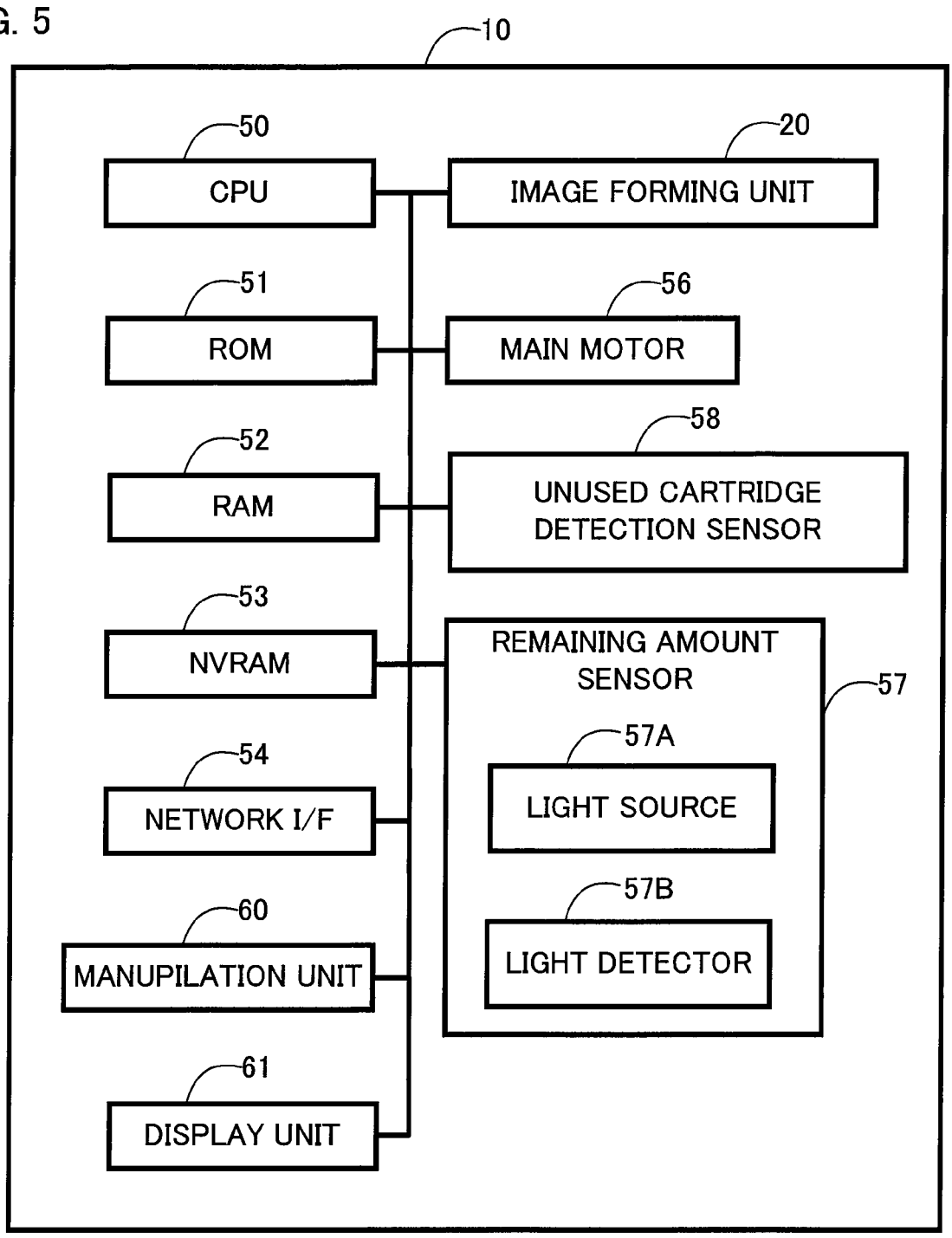
FIG. 5 is a block diagram of an electrical configuration of the printer according to an illustrative embodiment.

FIG. 5 is a block diagram of the electrical configuration of the printer 10.

The printer 10 is provided with a CPU 50, a ROM 51, a RAM 52, a non-volatile memory (NVRAM) 53 and a network interface 54 as illustrated in FIG. 5. Programs for the execution of various operations of the printer 10, such as a remaining amount detection process and a motor control process, which will be described later, are stored in the ROM 51.

The CPU 50 (which is an example of the determination unit, the detection unit, the timing unit and the calculation unit) controls each unit in accordance with the programs read from the ROM 51 and, at the same time, stores the processing result in a storage unit such as RAM 52 in this example of the storage unit or the NVRAM 53. The network interface 54 is connected to a communication line, such as a LAN, to enable communication between the network interface 54 and, for example, terminal units (not illustrated) connected to the communication line.

The printer 10 is also provided with a main motor 56, a remaining amount sensor 57 and unused cartridge detection sensor 58. The main motor 56 is connected to, for example, the pickup roller 15, the feed roller 16, the resist roller 18, the photoconductor drum 26 and the agitator 35 via a gear mechanism to drive these members to rotate.

A sensor or detector such as the remaining amount sensor 57 illustrated in FIG. 3 is provided to detect the amount of developing agent remaining in the container unit 30. The remaining amount sensor 57 is provided with a light emitting unit 57A and a light receiving unit 57B in the apparatus main body 11. The light emitting unit 57A is disposed opposite to one of the window units 36 of the development cartridge 28; and the light receiving unit 57B is disposed opposite to the other of the window units 36. The light emitting unit 57A emits light toward the container unit 30 through one of the window units 36. The light receiving unit 57B receives the light emitted by the light emitting unit 57A, passed through the container unit 30 and output from the other of the window units 36. The light receiving unit 57B then outputs the voltage in accordance with an amount of received light. The remaining amount sensor 57 compares the voltage output from the light receiving unit 57B with a predetermined threshold and outputs an H level signal or an L level signal to the CPU 50.

The unused cartridge detection sensor 58 detects whether the detector member 38 of the development cartridge 28 is at the unused cartridge position and outputs the detection result to the CPU 50.

The printer 10 is further provided with a manipulation unit 60 and a display unit 61. For example, the display unit 61 is provided with a display and a lamp and can display various setting screens and operating states of the apparatus. The manipulation unit 60 is provided with a plurality of buttons, with which a user can input various instructions.

Relationship between Toner State and Output from Remaining Amount Sensor

Next, a relationship between a toner state and an output of the remaining amount sensor 57 will be described.

The remaining amount sensor 57 outputs an H level signal when the amount of received light of the light receiving unit 57B is smaller than a predetermined amount and outputs an L level signal when the amount of received light is larger than the predetermined amount.

If the container unit 30 is filled with toner, the light emitted from the light emitting unit 57A is blocked by the agitator 35 and the toner and therefore cannot reach the light receiving unit 57B; thus an output of the remaining amount sensor 57 is always an H level signal.

As the amount of remaining toner is reduced to some extent, the light emitted from the light emitting unit 57A is blocked by the agitator 35 when the agitator 35 covers the window unit 36 whereas the light reaches the light receiving unit 57B through a gap created in accordance with the amount of toner when the agitator 35 does not cover the window unit 36. For this reason, the remaining amount sensor 57 alternately outputs H level signals and L level signals in a periodic manner as the agitator 35 rotates.

As the amount of remaining toner is reduced, the gap created in accordance with the amount of toner becomes large when the agitator 35 does not cover the window unit 36. Thus a ratio of the time at which an L level signal is output for each 360-degree rotation of the agitator 35 (hereinafter, "duty ratio") becomes high. In the later-described remaining amount detection process, the CPU 50 obtains the duty ratio by counting time at which the remaining amount sensor 57 outputs L level signals for each 360-degree rotation of the agitator 35, and calculates a measurement result, for example calculates the duty ratio as an obtained value.

Figure 6:
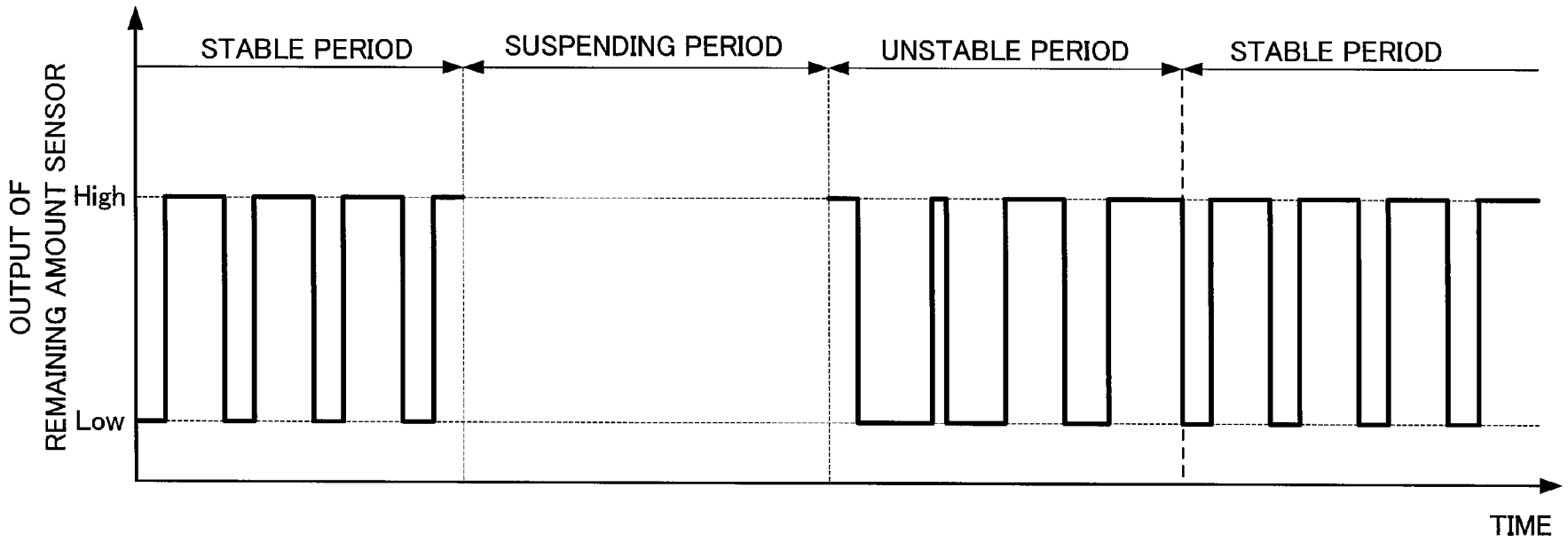
FIG. 6 is an explanatory view illustrating a relationship between a state of toner and an output of a remaining amount sensor.

FIG. 6 is an explanatory view illustrating a relationship between a state of the toner and an output of the remaining amount sensor 57.

In a state in which the toner in the container unit 30 is fully agitated, the flowability of toner is high and thus a change in an output waveform of the remaining amount sensor 57 for each 360-degree rotation of the agitator 35, i.e., a change in the duty ratio, is relatively small. Such a period in which the obtained value is stabilized will be called a stable period. In the ROM 51, for example, a table representing a correlation between the duty ratio, which is previously measured in a state in which the flowability of toner is high, and an amount of remaining toner is stored. When the amount of remaining toner is detected in accordance with the obtained value obtained from the output of the remaining amount sensor 57 during the stable period and in accordance with the table, it is considered that a relatively precise detected value is obtained.

A period in which the main motor 56 is stopped and the toner is not agitated by the agitator 35 when, for example, the printer 10 is in a sleep mode, will be called a suspending period of agitation. It is considered that the flowability of toner is lowered as the suspending period of agitation is extended.

In a state in which the flowability of toner is lowered when, for example, the agitator 35 starts agitating the toner after the suspending period of agitation continued for long periods of time, a change in the output waveform of the remaining amount sensor 57 for each 360-degree rotation of the agitator 35 (i.e., a change in the duty ratio) becomes large. Such a period in which the output of the remaining amount sensor 57 is not stabilized will be called an unstable period.

In the unstable period in which flowability of toner is lowered, the duty ratio tends to become high (i.e., a ratio of the L level signals tends to become high) as compared with the duty ratio in the stable period. Accordingly, if the amount of remaining toner is detected in accordance with the output of the remaining amount sensor 57 during the unstable period, it is highly possible that a detected value which is smaller than an actual value is obtained.

As the toner with lowered flowability is agitated by the agitator 35, the flowability recovers. For this reason, the duty ratio during the unstable period tends to be the highest immediately after the end of the suspending period of agitation (i.e., immediately after the start of agitation) and be lowered gradually as the agitation continues. The unstable period shifts to the stable period when the flowability of toner recovers to some extent. Since the degree of lowering of the flowability of toner becomes high as the suspending period of agitation is extended, it is considered that the length of the unstable period increases as the suspending period of agitation is extended.

Remaining Amount Detection Process

Figure 7:
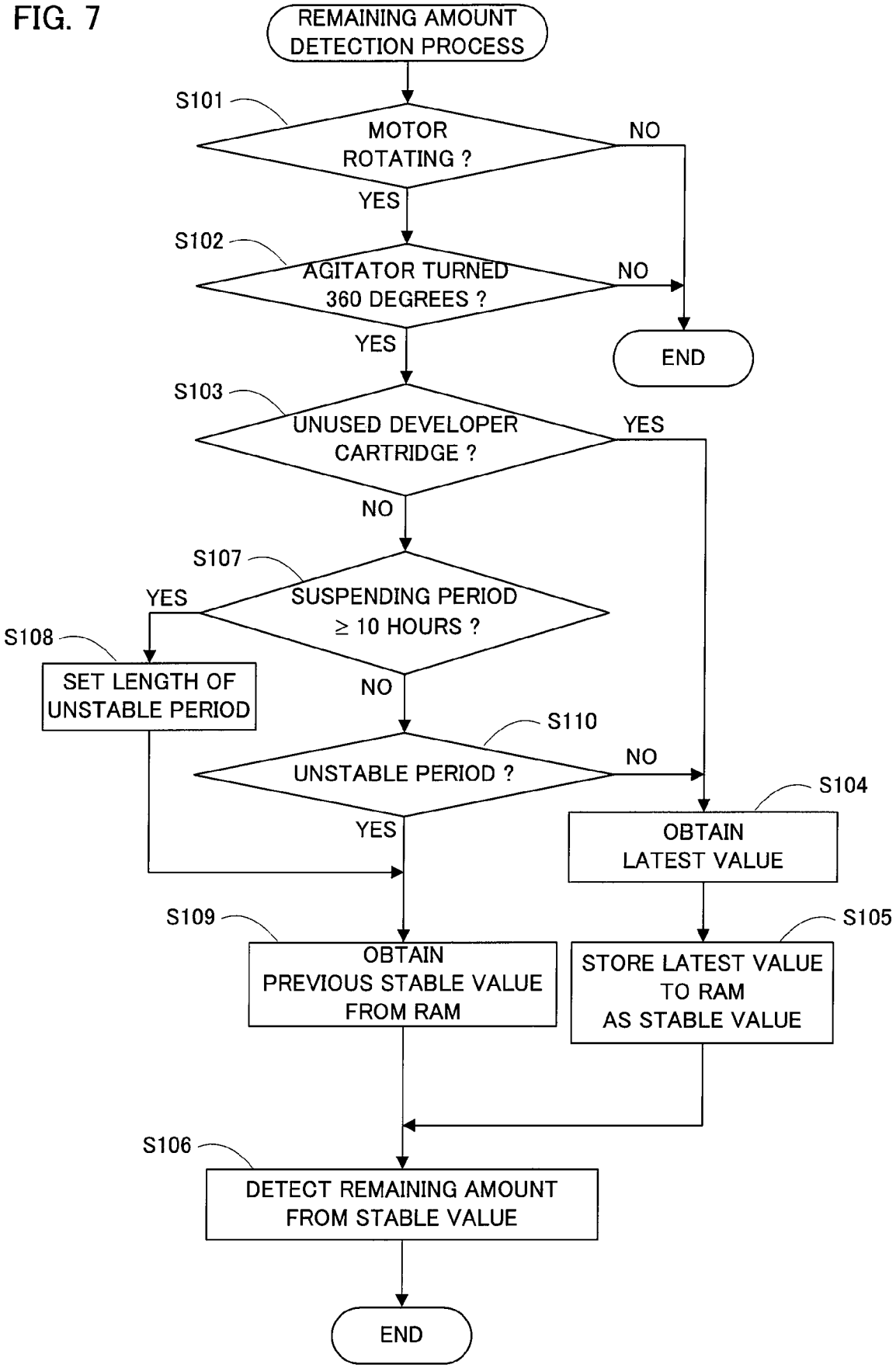
FIG. 7 is a flowchart of a remaining amount detection process according to an illustrative embodiment.

Next, an operation of the remaining amount detection process for detecting the amount of remaining toner will be described. FIG. 7 is a flowchart of the remaining amount detection process.

While the printer 10 is powered on, the remaining amount detection process is performed repeatedly at an interval of each 360-degree rotation or less of the agitator 35 under the control of the CPU 50.

When the remaining amount detection process of FIG. 7 is started, the CPU 50 first determines whether the main motor 56 is rotating, i.e., whether the agitator 35 is rotating (S101). If it is determined that the main motor 56 is not rotating (S101: NO), the remaining amount detection process is completed.

When the main motor 56 is rotating (S101: YES), the CPU 50 determines whether the agitator 35 has made a 360-degree rotation (S102). If it is determined that the agitator 35 has not made a 360-degree rotation (S102: NO), the remaining amount detection process is completed. For example, the CPU 50 counts the time from the start of driving the agitator 35 and determines that the agitator 35 has made a 360-degree rotation whenever the count equivalent to a 360-degree rotation of the agitator 35 increases. That is, in the remaining amount detection process, whenever the agitator 35 has made a 360-degree rotation, the process of S103 and subsequent processes will be performed.

When the agitator 35 has made a 360-degree rotation (S102: YES), the CPU 50 determines whether the development cartridge 28 is an unused cartridge in accordance with the output of the unused cartridge detection sensor 58 (S103). Here, since the unused development cartridge 28 is filled with toner, whether it is currently a stable period or an unstable period hardly impacts the output of the remaining amount sensor 57. Thus, in the remaining amount detection process, processes which are the same as those performed when it is determined to be a stable period will be performed.

That is, when the development cartridge 28 is an unused cartridge (S103: YES), the CPU 50 obtains the latest value in accordance with the output of the remaining amount sensor 57 (S104). In particular, the time at which the output is the L level signals for each 360-degree rotation of the agitator 35 is counted and the duty ratio is calculated in accordance with the count. If the development cartridge 28 is an unused cartridge, the duty ratio is 0%.

The CPU 50 stores the obtained value in the RAM 52 as a stable value obtained during the stable period (S105). If stable values obtained in the past have been stored in RAM 52, those values are replaced with the newly obtained value.

The CPU 50 then detects the amount of remaining toner in accordance with the latest value obtained in S104 (S106). Here, the CPU 50 refers to, for example, a table representing a relationship between the duty ratio and the amount of remaining toner, calculates the amount of remaining toner corresponding to the latest value and stores the calculation result in the RAM 52 as a detected value.

If the development cartridge 28 is not an unused cartridge (S103: NO), the CPU 50 determines whether the suspending period of agitation has lasted for 10 or more hours (S107). The CPU 50 can calculate the length of the suspending period of agitation by, for example, starting counting the time since the main motor 56 is stopped and knowing the count at which the main motor 56 is rotated again. In step S107, if the agitator 35 has just made a 360-degree rotation since the agitation started and the length of the suspending period of agitation immediately therebefore is 10 hours or more, the process proceeds to YES (S107: YES), and otherwise, proceeds to NO (S107: NO).

If the suspending period of agitation is 10 hours or more (S107: YES), the CPU 50 determines that the current period is the unstable period and sets the length of the unstable period in accordance with the length of the suspending period of agitation (S108). Here, the length of the unstable period is estimated such that the length of the unstable period increases as the suspending period of agitation is extended; for example, if the suspending period of agitation is one day (24 hours), the length of the unstable period is set to 10 seconds and if the suspending period of agitation is five days (120 hours), the unstable period is set to 20 seconds. A value corresponding to the length of the estimated unstable period is set to a counter for the measurement of the duration of the unstable period and counting down until the counter becomes 0 is started.

Then the CPU 50 obtains the previous stable value stored in the RAM 52 in S105 of the previous remaining amount detection process (S109). The process then proceeds to S106 where the amount of remaining toner is detected in accordance with the obtained stable value.

As described above, in the remaining amount detection process, immediately after starting the agitation after 10 hours or more of the suspending period of agitation, the current period is determined to be an unstable period and the amount of remaining toner is detected by using a stable value, i.e., the obtained value previously obtained during the stable period and not using the latest value output from the remaining amount sensor 57.

If the length of the suspending period of agitation is less than 10 hours (S107: NO), it is determined whether the current period is the unstable period (S110). If a length of the unstable period set in S108 in another previous remaining amount detection process has elapsed (i.e., counting down has been completed), the current period is determined to be a stable period (S110: NO) and the process proceeds to S104. In S104, the latest value output from the remaining amount sensor 57 is obtained and stored as a stable value (S105) and then the amount of remaining toner is detected in accordance with the obtained value (S106).

If a length of the unstable period set in S108 in another previous remaining amount detection process has not elapsed (i.e., counting down is continued) (S110: YES), the current period is determined to be an unstable period (S110: YES) and the process proceeds to S109. According to S109, the previous stable value stored in the RAM 52 is obtained and the amount of remaining toner is detected in accordance with the obtained value (S106).

In this manner, the CPU 50 detects the amount of remaining toner and stores the detected value in the RAM 52 and then the remaining amount detection process is completed.

The detected value is used for reporting the amount of remaining toner to the user. For example, the remaining amount may be numerically displayed on the display unit 61 as "amount of remaining toner: 30%" or may be displayed as a graph. The remaining amount may alternatively be displayed in three stages: full, low and empty. If the detected remaining amount is smaller than a certain threshold, a warning that the toner cartridge should be replaced soon may be displayed. If the detected remaining amount is even smaller, which may be taken as an error and an operation, for example, to stop the print operation may be performed.

Further, when an inquiry is received from, for example, an external computer via the network interface 54, information about the remaining amount may be sent to the computer and displayed on a display of the computer. It is also possible that estimated remaining number of sheets that can be printed may be calculated in accordance with the detected value and reported to the user.

Motor Control Process

Figure 8:
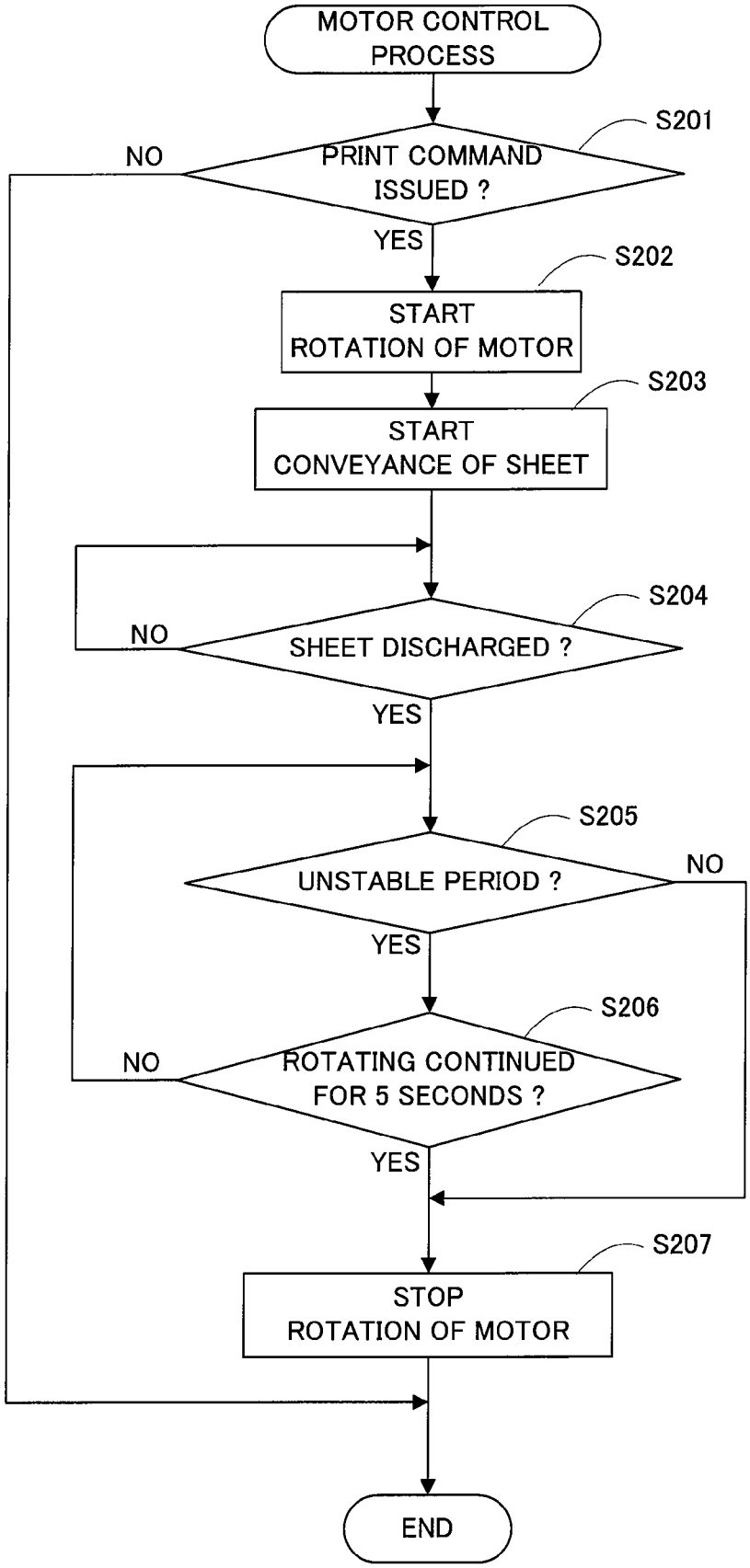
FIG. 8 is a flowchart of a motor control process according to an illustrative embodiment.

Next, an operation of the motor control process for controlling the operation of the main motor 56 will be described. FIG. 8 is a flowchart of the motor control process.

The motor control process is a process for controlling the rotation of the main motor 56 in response to a print command and, at the same time, for controlling the rotation of the agitator 35 driven by the main motor 56. While the printer 10 is powered on, the motor control process is repeatedly performed under the control of the CPU 50.

In the motor control process of FIG. 8, the CPU 50 determines whether a print command has been received from, for example, an external computer via the network interface 54 (S201). If no print command has been received (S201: NO), the motor control process is completed.

If a print command has been received (S201: YES), the CPU 50 causes the main motor 56 to start rotating (S202) and then causes the sheet 13 to start being conveyed from the supply tray 14 (S203). At the same time, the CPU 50 causes the image forming unit 20 to start an image forming process as described above and causes an image in accordance with the print command to be printed on the sheet 13 conveyed to the image forming unit 20.

Then the CPU 50 determines whether the discharge of the printed sheet 13 has been completed, i.e., whether the printing has been completed, by a discharge sensor (not illustrated) provided on a conveying path of the sheet 13 (S204). If the discharge of the sheet 13 has not been completed (S204: NO), the CPU 50 repeats the step of S204 until the discharge is completed.

If the discharge of the sheet 13 has been completed (S204: YES), the CPU 50 determines whether the current period is an unstable period (S205). Here, if the length of the unstable period set in S108 of the remaining amount detection process as illustrated in FIG. 7 has not elapsed (i.e., counting down is continued), the CPU 50 determines that the current period is an unstable period. If the current period is an unstable period (S205: YES), the CPU 50 causes the main motor 56 to be continuously rotated, i.e., causes the agitator 35 to continuously agitate the toner. At the same time, the CPU 50 determines whether the duration of the rotation of the main motor 56 has reached a specified time, for example 5 seconds, after the completion of printing (S206). If the duration of the rotation has not reached the specified time (5 seconds in this example) (S206: NO), the process returns to S205.

When the unstable period has expired (S205: NO), the CPU 50 causes the main motor 56 to stop rotating (S207). Thus rotation of the agitator 35 also stops. If the unstable period has not expired (S205: YES), when the duration of the rotation of the main motor 56 reaches 5 seconds (S206: YES) after the completion of printing, the process proceeds to S207, where the CPU 50 causes the main motor 56 to stop rotating. The CPU 50 then causes the motor control process to be completed.

That is, in the motor control process, if it is determined that the current period is an unstable period at the time of completion of printing, the agitator 35 continues agitating the toner until the unstable period expires or 5 seconds elapses, whichever comes first.

In the motor control process, step S206 may be omitted and, if it is determined in S205 that the unstable period has not expired (S205: YES), the process returns to S205, where the CPU 50 stands by until the unstable period expires and, if the unstable period has expired (S205: NO), rotation of the main motor 56 may be stopped (S207).

In the motor control process, step S205 may be omitted and, after the discharge of the sheet 13 is completed (S204: YES), the process proceeds to S206 where the CPU 50 stands by until 5 seconds elapses. After 5 seconds elapses (S206: YES), the CPU 50 may cause the main motor 56 to stop rotating (S207).

Advantageous Effects of the Present Embodiment

As described above, according to the illustrative embodiment, if it is determined that the current period is an unstable period in which the measurement result of the remaining amount sensor 57 is not stabilized (S110: YES), the amount of remaining toner is detected in accordance with the measurement result stored in the RAM 52 previously measured during the stable period (S109, S106) rather than using the latest measurement result output from the remaining amount sensor 57. Thus a precise detection result can be obtained.

Since whether the current period is an unstable period or a stable period is determined in accordance with the length of the suspending period of agitation (S108), a precise determination can be made.

The length of the unstable period from the start of the agitation is estimated and, in accordance with the length of the estimated unstable period, it is determined whether the current period is an unstable period or a stable period; the length of the unstable period is estimated to increase as the length of the suspending period of agitation is extended (S108, S110). Thus a precise determination can be made.

If the unstable period has not expired at the time of completion of printing (S205: YES), the image forming unit 20 continues agitation of the toner until the unstable period expires. With this process, since the measurement result is easily stabilized as compared with a case in which agitation is stopped immediately after the completion of printing, a precise detection in accordance with the latest measurement result can be performed at an early stage.

For example, after the completion of printing, if the agitation is continued until the unstable period expires and then stopped, it is determined that the current period is a stable period if the agitation is resumed in a state in which the length of the suspending period of agitation is less than 10 hours; thus the remaining amount can be immediately detected in accordance with the output of the remaining amount sensor 57.

If the unstable period has not expired at the time of completion of printing (S205: YES), the image forming unit 20 continues agitation until a predetermined period (5 seconds) elapses (S206). With this process, since the measurement result is easily stabilized as compared with a case in which agitation is stopped immediately after the completion of printing, a precise detection in accordance with the latest measurement result can be performed at an early stage.

Second Illustrative Embodiment

Figure 9:
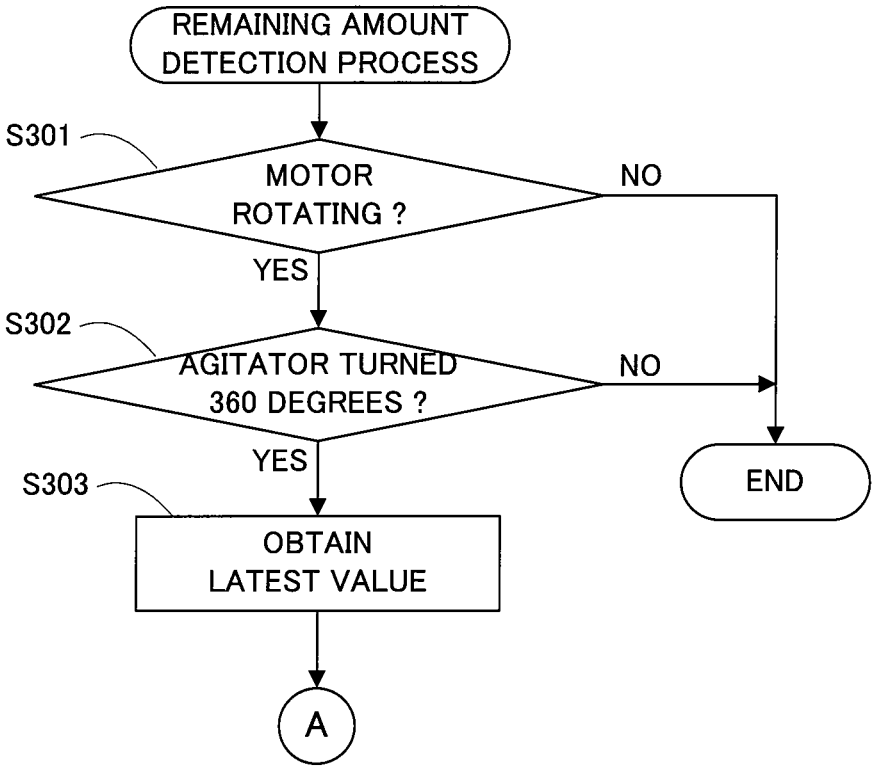
FIG. 9 is a flowchart of a remaining amount detection process according to a second illustrative embodiment.
Figure 10:
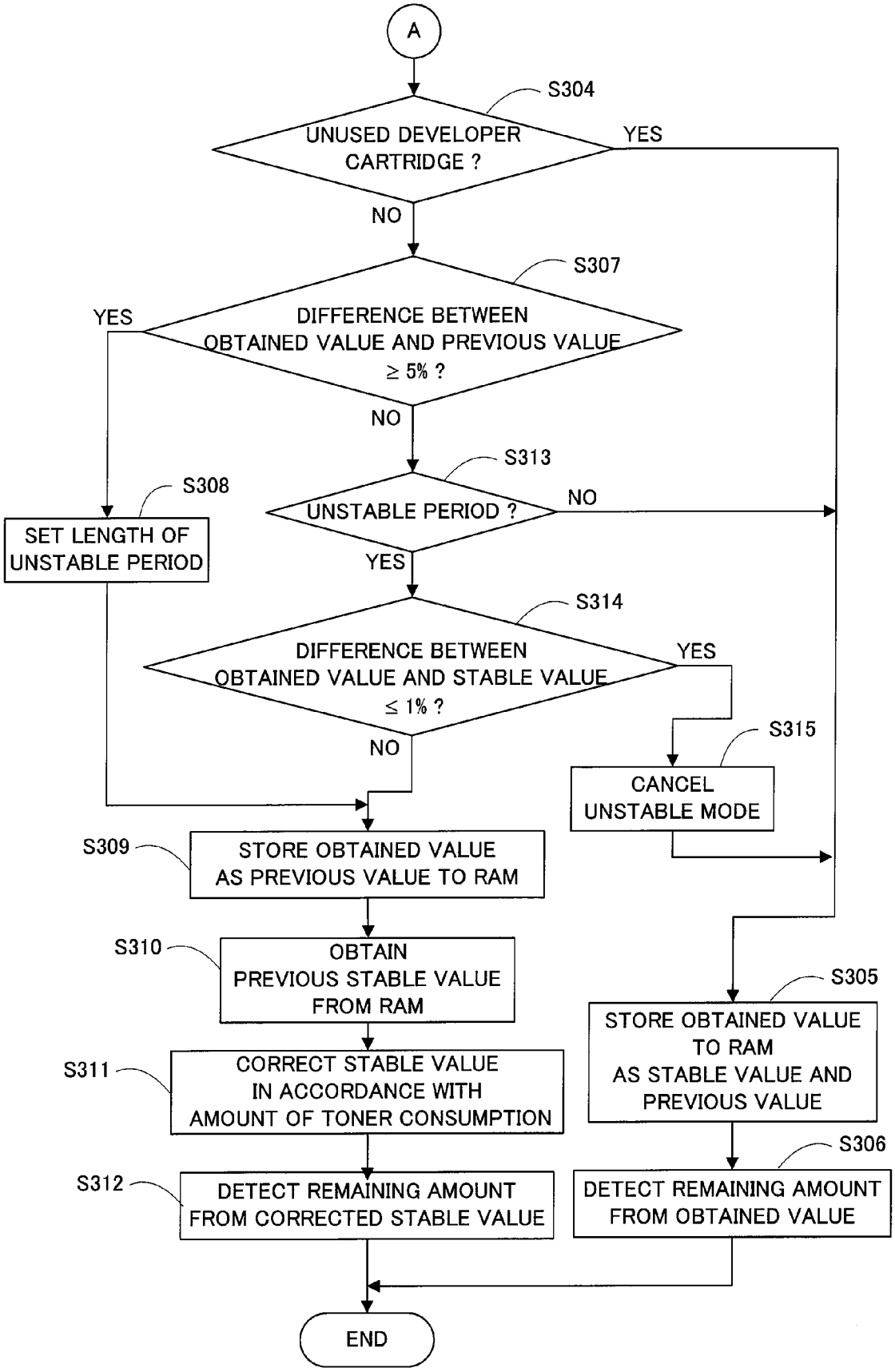
FIG. 10 is a flowchart of the remaining amount detection process according to the second illustrative embodiment.

Next, a second illustrative embodiment will be described with reference to FIGS. 9 and 10. FIGS. 9 and 10 are flowcharts of a remaining amount detection process.

The present illustrative embodiment differs from the above-described illustrative embodiment in the method of determining an unstable period. A configuration of a printer 10 and a motor control process of the present illustrative embodiment are the same as those of the above-described illustrative embodiment; configurations similar to those of the above-described illustrative embodiment will be denoted by the same reference numerals and description thereof will be omitted.

After a remaining amount detection process is started, a CPU 50 determines whether a main motor 56 is rotating (S301) as illustrated in FIG. 9. If the main motor 56 is not rotating (S301: NO), the CPU 50 causes the remaining amount detection process to be completed. If the main motor 56 is rotating (S301: YES), it is determined whether an agitator 35 has made a 360-degree rotation (S302). If the agitator 35 has not made a 360-degree rotation (S302: NO), the remaining amount detection process is completed.

If the main motor 56 has made a 360-degree rotation (S302: YES), the CPU 50 obtains the latest value in accordance with the output of a remaining amount sensor 57 (S303). The CPU 50 then determines whether a development cartridge 28 is an unused cartridge in accordance with the output of an unused cartridge detection sensor 58 as illustrated in FIG. 10 (S304).

If the development cartridge 28 is an unused cartridge (S304: YES), the CPU 50 stores the obtained value in RAM 52 as a previous value and a stable value (S305). The previous value is used for the reference of a previous value and the stable value is used for the reference of an obtained value measured during the stable period as described above. The CPU 50 then detects an amount of remaining toner in accordance with the obtained value (S306) and causes the remaining amount detection process to be completed.

If the development cartridge 28 is not an unused cartridge (S304: NO), the CPU 50 determines whether a difference between the obtained latest value and the previous value stored in the RAM 52 (i.e., a previous value) is 5% or more (S307). If the difference between the latest value and the previous value is 5% or more (S307: YES), the CPU 50 determines that the current period is an unstable period and sets the length of the unstable period in accordance with the difference (S308).

Here, it is estimated that the length of the unstable period increases as the difference between the latest value and the previous value becomes large. A value corresponding to the length of the estimated unstable period is set to a count value for the measurement of the duration of the unstable period and counting down is started. If this step is performed again in another remaining amount detection process during the counting down, the previous count value is canceled and a new value is set.

Next, the CPU 50 stores the value obtained in S303 as a previous value in the RAM 52 (S309) and then reads a previous stable value out of the RAM 52 (S310). The CPU 50 then corrects the stable value in accordance with an amount of toner consumption since the stable value is stored until present (S311).

The amount of consumption of toner is calculated in accordance with, for example, the number of sheets printed since the stable value is stored until present and a printing area of each sheet. The printing area of a sheet can be calculated by, for example, counting the number of pixels (i.e., the number of dots) to be colored in the print data supplied to the image forming unit 20.

For example, it is assumed that the amount of toner consumption when printed in 5% of the print area of each of three sheets 13 is equivalent to 1% of the duty ratio. If the stored stable value is 20% of the duty ratio and printing is made in 5% of the print area of each of the three sheets 13 since the stable value is stored until present, the CPU 50 adds 1% of the duty ratio to the stable value to let the obtained 21% be a corrected value. Similarly, if the stored stable value is 20% of the duty ratio and printing is made in 50% of the print area of each of the three sheets 13, the CPU 50 calculates that the amount of toner consumption corresponds to 10% of the duty ratio, and adds 10% of the duty ratio to the stable value to let 30% be a corrected value.

The CPU 50 then detects the amount of remaining toner from the corrected value (S312) and causes the remaining amount detection process to be completed. That is, in the above-described steps S311 and S312, the current amount of remaining toner is detected by a calculation equal to subtracting the amount of toner consumption since the previous obtained value until present from the amount of remaining toner corresponding to the previous obtained value.

If the CPU 50 determines in S307 that the difference between the obtained value and the previous value is less than 5% (S307: NO), the CPU 50 determines whether the current period is an unstable period (S313). Here, if the unstable period set in S308 of the previous remaining amount detection process is not continued (i.e., counting down is not continued), the CPU 50 determines that the current period is a stable period (S313: NO) and the process proceeds to S305. In S305, the obtained value obtained in S303 is stored as a previous value and a stable value, an amount of remaining toner is detected from the obtained value (S306) and the remaining amount detection process is completed.

If it is determined in S313 that the current period is an unstable period (S313: YES), the CPU 50 determines whether a difference between the obtained value and the stable value is 1% or less (S314). If the difference is 1% or less (S314: YES), the difference between the obtained value and the stable value is relatively small; thus the determination that the current period is an unstable period can be corrected and the current period can be determined as a stable period. The CPU 50 then cancels the setting of the unstable period set in S308 (i.e., the CPU 50 clears the counter) (S315) and the process proceeds to S305 where the CPU 50 detects the amount of remaining toner in accordance with the obtained latest value.

If the difference between the obtained value and the stable value is larger than 1% (S313: NO), the determination that the current period is an unstable period can be supported: thus the process proceeds to S309 where the amount of remaining toner is detected in accordance with the previous stable value.

In the remaining amount detection process, the steps S314 and S315 in which the determination about the unstable period is corrected may be omitted. In this case, if it is determined in S313 that the current period is an unstable period (S313: YES), the process proceeds to S309 where the remaining amount may be detected in accordance with a previous stable value.

In the remaining amount detection process, the steps of S307, S308, S313 and S315 may be omitted. If it is determined that the development cartridge 28 is not an unused cartridge (S304: NO), the CPU 50 determines whether the difference between the obtained value and the stable value is 1% or less (S314). If the difference is 1% or less (S314: YES), the CPU 50 may determine that the current period is a stable period and the process may proceed to S305. If the difference is larger than 1% (S314: NO), the CPU 50 may determine that the current period is an unstable period and the process may proceed to S309.

As described above, according to the present illustrative embodiment, the length of the unstable period since the agitation is started is estimated (S308) and it is determined whether the current period is an unstable period or a stable period in accordance with the length of estimated unstable period (S313). The length of the unstable period is estimated to increase as the difference between the previous measurement result stored during the stable period and the latest measurement result output from the remaining amount sensor 57 becomes large. With this process, a precise determination can be made.

Alternatively, when the change in the latest measurement result output from the remaining amount sensor 57 with respect to a previous measurement result is greater than or equal to a predetermined threshold (1%), the CPU 50 determines that the current period is an unstable period; and when the change is smaller than the predetermined threshold, the CPU 50 determines that the current period is a stable period (S314). With this process, a precise determination can be made.

Since the remaining amount is detected by subtracting an amount of consumption from that time onwards from the remaining amount at the time of the previous measurement (S311, S312), a more precise detection can be made as compared with a case in which the remaining amount is detected only from the previous measurement result.

Other Illustrative Embodiments

The disclosure is not limited to the illustrative embodiments described with reference to the description and the drawings; for example, the following illustrative embodiments are also included in the technical scope of the disclosure.

(1) In the above-described illustrative embodiments, aspects are applied to a monochrome laser printer; however, aspects may also be applied to, for example, LED printers and color image forming apparatuses.

(2) In the above-described illustrative embodiments, an example in which a driving source of the agitator 35 is the main motor 56 which is also a driving source of the rollers used for the conveyance of the sheet 13 has been described; however, according to certain aspects, the driving source of the agitation unit may be provided independently from that of, for example, the components for the conveyance of the sheet. As such, the toner can be agitated at the time irrespective of the conveyance of the sheet.

(3) When the amount of remaining developing agent is to be detected if it is determined that the current period is a stable period, the measurement result obtained from the sensor immediately before the determination or the measurement result which is output from the sensor after the determination may be used as the latest measurement result.

(4) Conditions under which the length of the unstable period is estimated or conditions under which it is determined whether the current period is an unstable period are not limited to those described above and may be altered. For example, the conditions may be changed in accordance with the temperature and humidity. Flowability of the developing agent is typically lower in high temperature and high humidity. Accordingly, for example, the conditions may be determined such that the length of the unstable period increases at higher temperatures measured by a temperature sensor or higher humidity measured by a moisture sensor. Alternatively, the conditions may be determined such that the determination regarding the current period being an unstable period may be made easily.

(5) The development cartridge may be provided with a storage media, such as an IC tag, and a detection result of the amount of remaining toner may be stored in the storage medium. Information about whether the development cartridge is an unused cartridge (i.e., whether the toner is in an unused cartridge) may be stored in the storage medium, and whether the development cartridge is an unused cartridge may be determined in accordance with the information read from the storage medium.

(6) In the above-described illustrative embodiments, an example in which the stable value, the previous value, the detected value and so forth are stored in the RAM 52 has been described; but these values may also be stored in the NVRAM. With this, the values can be saved even if the memory or the printer 10 is powered off. Alternatively, for example, the time at which agitation is stopped may be stored in the NVRAM and used for the calculation of the length of the suspending period of agitation. The length of the suspending period of agitation is calculated from the difference between the time at which the agitation is stopped read from the NVRAM when the agitation is resumed and the present time.

(7) In the above-described illustrative embodiments, an example in which whether the current period is an unstable period or a stable period is determined in accordance with the difference between the latest value and the previous value, or the difference between the latest value and the stable value has been described; however, the determination may also be made in accordance with a rate of change, not the difference.

Alternatively, for example, it is possible to determine that the current period is a stable period if the degree of variation of the latest three or more obtained values is smaller than a predetermined threshold and determine that the current period is an unstable period if the degree of variation is larger than the predetermined threshold. With this process, an influence of a measurement error can be reduced. An average of the latest several obtained values stored during the stable period may also be used as the stable value. With this process, the influence of the measurement error can be reduced.

(8) In the above-described illustrative embodiments, an example in which the functions of the determination unit, the detection unit, the timing unit and the calculation unit are implemented by the same CPU has been described; however, these functions may also be constituted by independent CPUs, ASICs or other circuits according to other illustrative aspects.

What is claimed is:

1. An image forming apparatus, comprising:

an image forming unit which includes a container unit for containing a developing agent and an agitation unit for agitating the developing agent contained in the container unit, the image forming unit performing image formation using the developing agent;

a sensor which includes a light emitting unit configured to emit light toward the container unit and a light receiving unit configured to receive the light emitted from the light emitting unit and passing through the container unit, the sensor generating an output in accordance with an amount of light received by the light receiving unit while the agitation unit agitates the developing agent;

a storage unit;

a processing unit;

memory having machine readable instructions stored thereon that, when executed by the processing unit, perform the steps of:

calculating a measurement result based on the output generated by the sensor;

determining, after the agitation is started, whether a current period is an unstable period in which the measurement result is unstable or a stable period in which the measurement result is stable; and storing the measurement result in the storage unit during the stable period;

during the stable period, detecting an amount of remaining developing agent in accordance with the latest measurement result based on the latest output generated by the sensor; and during the unstable period, detecting the amount of remaining developing agent in accordance with a previous measurement result stored in the storage unit, wherein the memory further has machine readable instructions stored thereon that, when executed by the processing unit, further perform the step of measuring a length of a suspending period of agitation from when the agitation unit stops performing agitation until when the agitation unit starts performing agitation, wherein the determining step determines whether the current period is the unstable period or the stable period in accordance with the length of the suspending period of agitation, and wherein the determining step includes estimating the length of the unstable period from when the agitation unit starts performing agitation and determining whether the current period is the unstable period or the stable period in accordance with the estimated length of the unstable period, wherein the estimated length of the unstable period increases as the suspending period of agitation is extended.

2. The image forming apparatus according to claim 1, wherein the determining step includes determining that the current period is the unstable period when a difference between the latest measurement result based on the latest output generated by the sensor and the previous measurement result is greater than or equal to a predetermined threshold, and determining that the current period is the stable period when the difference is smaller than the predetermined threshold.

3. The image forming apparatus according to claim 1, wherein the image forming unit performs agitation at a time of image formation and, if the current period is the unstable period at a time of completion of the image formation, continues agitation until the current period is no longer the unstable period.

4. The image forming apparatus according to claim 1, wherein the image forming unit performs agitation at a time of image formation and, if the current period is the unstable period at a time of completion of the image formation, continues agitation until a predetermined period elapses.

5. The image forming apparatus according to claim 1, wherein the memory further has machine readable instructions stored thereon that, when executed by the processing unit, further perform the step of calculating an amount of consumption of the developing agent during the image formation, wherein the detecting step detects the amount of remaining developing agent during the unstable period by subtracting the amount of consumption after the previous measurement result is calculated from the amount of remaining developing agent corresponding to the previous measurement result stored in the storage unit.

6. An image forming apparatus comprising:

an image forming unit which includes a container unit for containing a developing agent and an agitation unit for agitating the developing agent contained in the container unit, the image forming unit performing image formation using the developing agent;

a sensor which includes a light emitting unit configured to emit light toward the container unit and a light receiving unit configured to receive the light emitted from the light emitting unit and passing through the container unit, the sensor generating an output in accordance with an amount of light received by the light receiving unit while the agitation unit agitates the developing agent;

a storage unit;

a processing unit;

memory having machine readable instructions stored thereon that, when executed by the processing unit, perform the steps of:

calculating a measurement result based on the output generated by the sensor;

determining, after the agitation is started, whether a current period is an unstable period in which the measurement result is unstable or a stable period in which the measurement result is stable; and storing the measurement result in the storage unit during the stable period;

during the stable period, detecting an amount of remaining developing agent in accordance with the latest measurement result based on the latest output generated by the sensor; and during the unstable period, detecting the amount of remaining developing agent in accordance with a previous measurement result stored in the storage unit, wherein the determining step includes estimating a length of the unstable period from when the agitation unit starts performing agitation and determining whether the current period is the unstable period or the stable period in accordance with the estimated length of the unstable period, wherein the estimated length of the unstable period increases as a difference between the previous measurement result stored in the storage unit and the latest measurement result output from the sensor increases.

7. A non-transitory machine readable medium having executable instructions stored thereon that, when executed by a processing unit in a system including an image forming unit for performing image formation and having a container unit for containing a developing agent and an agitation unit for agitating the developing agent contained in the container unit, a sensor having a light emitting unit configured to emit light toward the container unit and a light receiving unit configured to receive the light emitted from the light emitting unit and passing through the container unit, the sensor generating an output in accordance with an amount of light received by the light receiving unit while the agitation unit agitates the developing agent, and a storage unit, perform the steps of:

calculating a measurement result based on the output generated by the sensor;

determining, after the agitation is started, whether a current period is an unstable period in which the measurement result is unstable or a stable period in which the measurement result is stable; and storing the measurement result in the storage unit during the stable period;

during the stable period, detecting an amount of remaining developing agent in accordance with the latest measurement result based on the latest output generated by the sensor;

during the unstable period, detecting the amount of remaining developing agent in accordance with a previous measurement result stored in the storage unit; and measuring a length of a suspending period of agitation from when the agitation unit stops performing agitation until when the agitation unit starts performing agitation, wherein the determining step determines whether the current period is the unstable period or the stable period in accordance with the length of the suspending period of agitation, and wherein the determining step includes estimating the length of the unstable period from when the agitation unit starts performing agitation and determining whether the current period is the unstable period or the stable period in accordance with the estimated length of the unstable period, wherein the estimated length of the unstable period increases as the suspending period of agitation is extended.

8. The non-transitory machine readable medium according to claim 7, wherein the determining step includes determining that the current period is the unstable period when a difference between the latest measurement result based on the latest output generated by the sensor and the previous measurement result is greater than or equal to a predetermined threshold, and determining that the current period is the stable period when the difference is smaller than the predetermined threshold.

9. The non-transitory machine readable medium according to claim 7 having further executable instructions stored thereon that, when executed by the processing unit, further perform the step of calculating an amount of consumption of the developing agent during the image formation, wherein the detecting step detects the amount of remaining developing agent during the unstable period by subtracting the amount of consumption after the previous measurement result is calculated from the amount of remaining developing agent corresponding to the previous measurement result stored in the storage unit.

10. A non-transitory machine readable medium having executable instructions stored thereon that, when executed by a processing unit in a system including an image forming unit for performing image formation and having a container unit for containing a developing agent and an agitation unit for agitating the developing agent contained in the container unit, a sensor having a light emitting unit configured to emit light toward the container unit and a light receiving unit configured to receive the light emitted from the light emitting unit and passing through the container unit, the sensor generating an output in accordance with an amount of light received by the light receiving unit while the agitation unit agitates the developing agent, and a storage unit, perform the steps of:

calculating a measurement result based on the output generated by the sensor;

determining, after the agitation is started, whether a current period is an unstable period in which the measurement result is unstable or a stable period in which the measurement result is stable; and storing the measurement result in the storage unit during the stable period;

during the stable period, detecting an amount of remaining developing agent in accordance with the latest measurement result based on the latest output generated by the sensor; and during the unstable period, detecting the amount of remaining developing agent in accordance with a previous measurement result stored in the storage unit calculating a measurement result based on the output generated by the sensor;

determining, after the agitation is started, whether a current period is an unstable period in which the measurement result is unstable or a stable period in which the measurement result is stable; and storing the measurement result in the storage unit during the stable period;

during the stable period, detecting an amount of remaining developing agent in accordance with the latest measurement result based on the latest output generated by the sensor; and during the unstable period, detecting the amount of remaining developing agent in accordance with a previous measurement result stored in the storage unit, wherein the determining step includes estimating a length of the unstable period from when the agitation unit starts performing agitation and determining whether the current period is the unstable period or the stable period in accordance with the estimated length of the unstable period, wherein the estimated length of the unstable period increases as a difference between the previous measurement result stored in the storage unit and the latest measurement result output from the sensor increases.

* * * * *